US007346951B1

(12) United States Patent
Heaton

(10) Patent No.: US 7,346,951 B1
(45) Date of Patent: Mar. 25, 2008

(54) BEDSORE REDUCTION SYSTEM FOR BEDS

(76) Inventor: Steven C. Heaton, 59951 210th St., Pacific Junction, IA (US) 51561

( * ) Notice: Subject to any disclaimer, the term of this patent is extended or adjusted under 35 U.S.C. 154(b) by 0 days.

(21) Appl. No.: 11/595,673

(22) Filed: Nov. 9, 2006

(51) Int. Cl.
*A61G 7/057* (2006.01)
*A61G 7/015* (2006.01)

(52) U.S. Cl. ..... 5/715; 5/615; 5/713

(58) Field of Classification Search ..... 5/715, 5/615, 713, 710, 607, 714
See application file for complete search history.

(56) References Cited

U.S. PATENT DOCUMENTS 1,772,310 A * 8/1930 Hart ..... 5/713
3,485,240 A * 12/1969 Fountain ..... 601/148
4,527,298 A * 7/1985 Moulton ..... 5/615
4,807,313 A * 2/1989 Ryder et al. ..... 5/610
4,873,731 A * 10/1989 Williamson ..... 5/615
4,934,002 A * 6/1990 Watanabe ..... 5/607
4,977,629 A * 12/1990 Jones ..... 5/632
6,298,511 B1 * 10/2001 Collymore ..... 5/715
6,370,716 B1 * 4/2002 Wilkinson ..... 5/715
7,080,422 B2 * 7/2006 Ben-Levi ..... 5/715

* cited by examiner

*Primary Examiner*—Alexander Grosz
(74) *Attorney, Agent, or Firm*—Adam H. Jacobs

(57) ABSTRACT

A bedsore reduction system for beds includes a generally rectangular base plate, a mattress support plate and a diagonal connecting plate extending between said base plate and said mattress support plate and pivotably connecting the opposite side edges of the base plate and the mattress support plate. An inflatable upper wedge-shaped air chamber having a generally triangular cross-sectional shape is positioned between the mattress support plate and the diagonal connecting plate and an inflatable lower wedge-shaped air chamber having a generally triangular cross-sectional shape is positioned between the base plate and the diagonal connecting plate. Finally, a controllable inflation device such as a set of air pumps is operatively connected to the upper and lower wedge-shaped air chambers for inflating and deflating them such that the mattress support plate is adjustable in the yaw orientation relative to horizontal thereby tilting a mattress supported on thereon for prevention of bedsores.

18 Claims, 5 Drawing Sheets

BEDSORE REDUCTION SYSTEM FOR BEDS

BACKGROUND OF THE INVENTION

1. Technical Field

The present invention is directed to methods and devices for reducing or preventing bedsores in long-term care patients and, more particularly, to a bedsore reduction system for beds which includes a generally rectangular base plate, a generally rectangular mattress support plate, a diagonal connecting plate extending between the opposite side edges of the base plate and mattress support plate in a "Z" shape, upper and lower inflatable wedge-shaped air chambers positioned between the mattress support plate, the diagonal connecting plate and the base plate, and a controllable inflation device operatively connected to the upper and lower wedge-shaped air chambers for inflating and deflating the air chambers such that the diagonal connecting plate is pivotable relative to the base plate and the mattress support plate is pivotable relative to the diagonal connecting plate for adjusting the yaw orientation relative to horizontal of the mattress support plate and a mattress supported thereon.

2. Description of the Prior Art

Bedsores, unfortunately, are a common problem encountered by long-term medical care patients. Bedsores, also known as decubitus or pressure ulcers, are generally caused by consistent pressure being applied to specific points on the body such as would be caused by the weight of the patient laying on the bed. When a patient is generally immobile for an extended period of time, what occurs is that the constant pressure against the skin causes the blood vessels in the area to close, thus depriving the skin of nourishment and oxygen. When this occurs over an extended period of time, the tissue dies and the bedsore forms.

Although bedsores form in many location on the body, the areas that are most likely to be bedsore-prone are the spine, the coccyx, the hips, buttocks, heels and elbows, and for completely immobile patients, the scalp at the back of the head is also at risk. However, the most common situation which causes the production of bedsores is when a patient is unable to redistribute their body weight on a regular and consistent basis. In fact, bedsores can begin to form in as little as two hours of immobility, which is why it is preferred that the patient be repositioned every two hours or so. Of course, this presents another significant problem in the care of the bed-bound patient in that these persons require assistance in repositioning themselves which generally requires a medical care provider to attend to the patient every two hours. This can force the medical care provider to curtail other important tasks in order to perform the repositioning, and therefore the efficiency of the medical care provider is greatly reduced. There is therefore a need for a bedsore reduction system which is capable of functioning without constant supervision yet which will assist in the repositioning of the individual to reduce the probability of production of bedsores.

Several examples are found in the prior art which attempt to address and solve this problem, including such devices as those disclosed in Seiler, U.S. Pat. No. 4,947,500, and Thomas et al., U.S. Pat. No. 5,073,999. The Seiler invention, in particular, is intended to prevent or cure bedsores and includes a specially designed therapeutic mattress which includes a plurality of air-cushion groups which act to adjust the position of the patient laying on the highly modified therapeutic mattress. The significant disadvantages of the Seiler invention, however, are that implementation of the Seiler device throughout a hospital or other care facility would require replacing each and every one of the mattresses found throughout the hospital at significant cost to the hospital and further the design of the Seiler device provides only limited adjustment for prevention of bedsores. There is therefore a need for a significantly improved bedsore reduction system which may be used with a standard mattress and which may be retrofitted onto already purchased bedding units currently found in extended care facilities and hospitals.

Therefore, an object of the present invention is to provide an improved bedsore reduction system for beds.

Another object of the present invention is to provide an improved bedsore reduction system for beds which includes a generally rectangular base plate, a generally rectangular mattress support plate positioned initially parallel with and above the base plate, a diagonal connecting plate extending between the base plate and mattress support plate at opposite sides thereof in a Z-cross-sectional shape and hingedly connected thereto, upper and lower inflatable wedge-shaped air chambers positioned between each of the three plates, and a controllable inflation device operatively connected to the air chambers for alternatively inflating or deflating the air chambers to adjust the yaw orientation relative to horizontal of a mattress supported on the mattress support plate.

Another object of the present invention is to provide an improved bedsore reduction system for beds which also includes an inflatable head and shoulder unit positioned atop the mattress support plate for adjusting the position of the head and shoulders upwards and downwards relative to the mattress support plate thereby further facilitating reduction of bedsores by adjusting the pressure points of the back, shoulder area, neck and head.

Another object of the present invention is to provide a programmable timer and/or computerized control device in control connection with the inflation control device in order to slowly adjust the positioning of the mattress support plate and hence the mattress positioned thereon to address individually the bedsore reduction needs of the person bed-bound in the particular bed.

Another object of the present invention is to provide an improved bedsore reduction system for beds which is usable with already existing mattresses and mattress supports merely by resting between the mattress and bed springs or by replacing the bed springs of the original bed structure with the bedsore reduction system of the present invention.

Finally, an object of the present invention is to provide an improved bedsore reduction system for beds which is relatively simple in design and construction and which is safe, efficient and effective in use.

SUMMARY OF THE INVENTION

The present invention provides a bedsore reduction system for beds which includes a generally rectangular base plate having front and rear edges and first and second side edges and a generally rectangular mattress support plate operative to support a mattress thereon, the mattress support plate having front and rear edges and first and second side edges and being positioned above and initially generally parallel with the base plate. A diagonal connecting plate extends between the base plate and mattress support plate with pivoting hinged connections to the first side edge of the base plate and the second side edge of the mattress support plate such that the three plates form a generally Z-cross-sectional shape when viewed edge on. Upper and lower inflatable wedge-shaped air chambers are also provided, each having a generally triangular cross-sectional shape with the upper wedge-shaped air chamber positioned between the mattress support plate and the diagonal connecting plate and the lower wedge-shaped air chamber positioned between the base plate and diagonal connecting plate to generally fill the spaces between the plates and keep the mattress support plate generally parallel with the base plate in its initial position. Finally, a controllable inflation device such as a compressed air pump and valve system is operatively connected to the upper and lower wedge-shaped air chambers for inflating and deflating the upper and lower wedge-shaped air chambers such that the diagonal connecting plate is pivotable relative to the base plate via deflation and inflation of the lower wedge-shaped air chamber and the mattress support plate is pivotable relative to the diagonal connecting plate via inflation and deflation of the upper wedge-shaped air chamber, thereby adjusting the yaw orientation relative to horizontal of a mattress supported on the mattress support plate. A head and shoulder support and adjustment air chamber may also be provided which is generally wedge-shaped with the thick end positioned adjacent the front edge of the mattress support plate to raise and lower the head and shoulders of the user of the present invention relative to the mattress support plate.

It is thus seen that the bedsore reduction system for beds of the present invention provides many significant improvements which are neither disclosed nor suggested in the prior art. Specifically, the "Z" cross-sectional shape of the three plates, when assembled, permits simple and safe adjustment of the yaw orientation relative to horizontal of the mattress supported on the mattress support plate, and controlled inflation and deflation of the upper and lower wedge-shaped air chambers and the head and shoulders support air chamber will result in an almost limitless number of positions in which the mattress may be supported, thereby generally eliminating continuous pressure points on particular locations of the patient's body as are found in connection with standard bedding assemblies currently being used. Also, because the present invention rests between the mattress and box spring of the box spring and mattress set, or may even replace the box spring itself, it is possible to use an already-purchased mattress in connection with the present invention, a feature not found in the vast majority of devices found in the prior art. Finally, and perhaps most importantly, the controllable inflation device may be programmed to inflate or deflate the various air chambers in a preset pattern which may be tailored to the individual needs of the patient, and therefore medical care providers will not find it necessary to tend to the patient every two hours as currently recommended. It is therefore seen that the present invention provides a substantial improvement over those devices and systems found in the prior art.

DESCRIPTION OF THE PREFERRED EMBODIMENT

Figure 1:
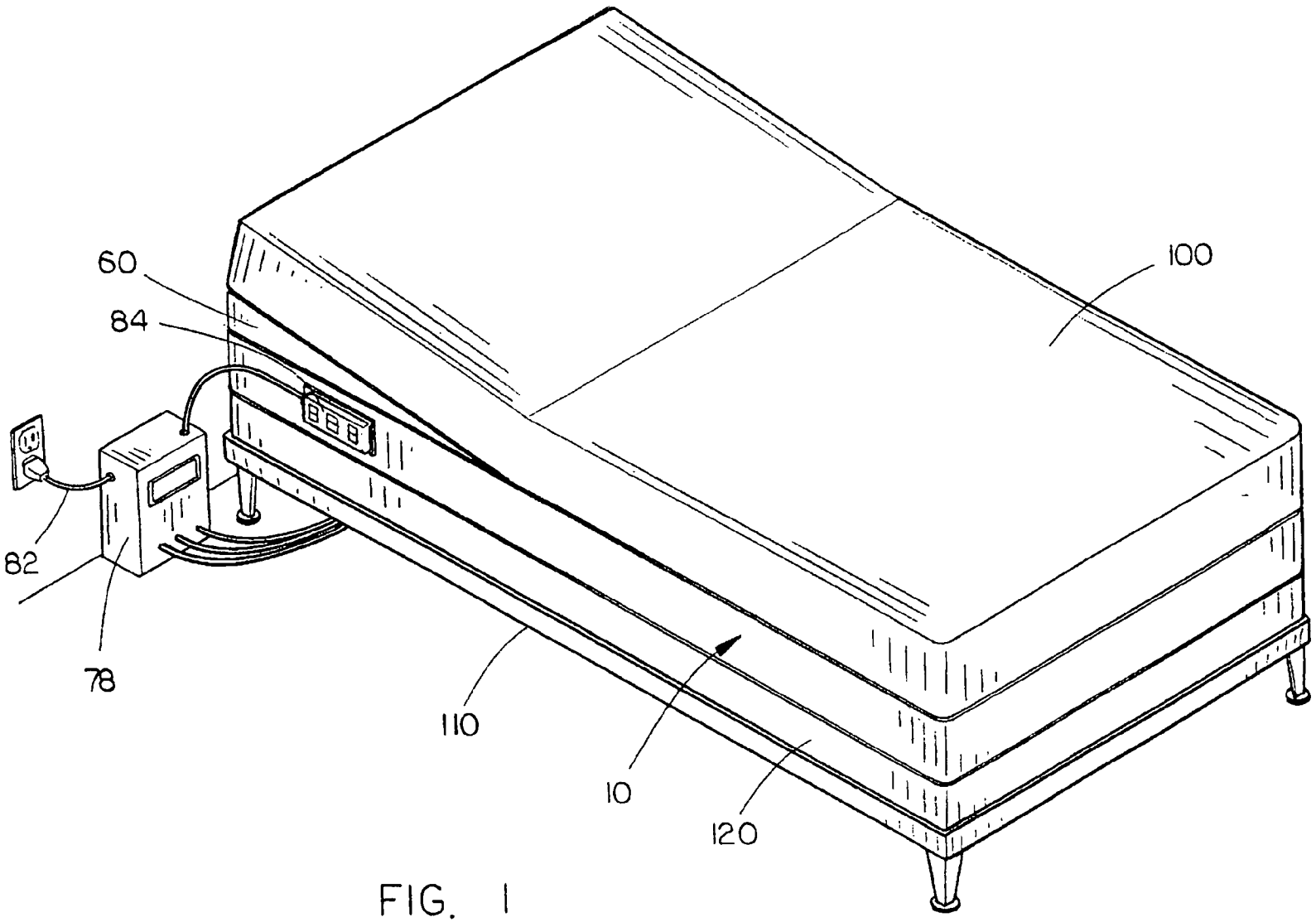
FIG. 1 is a perspective view of the bedsore reduction system for beds of the present invention fitted onto a standard bed support assembly.
Figure 2:
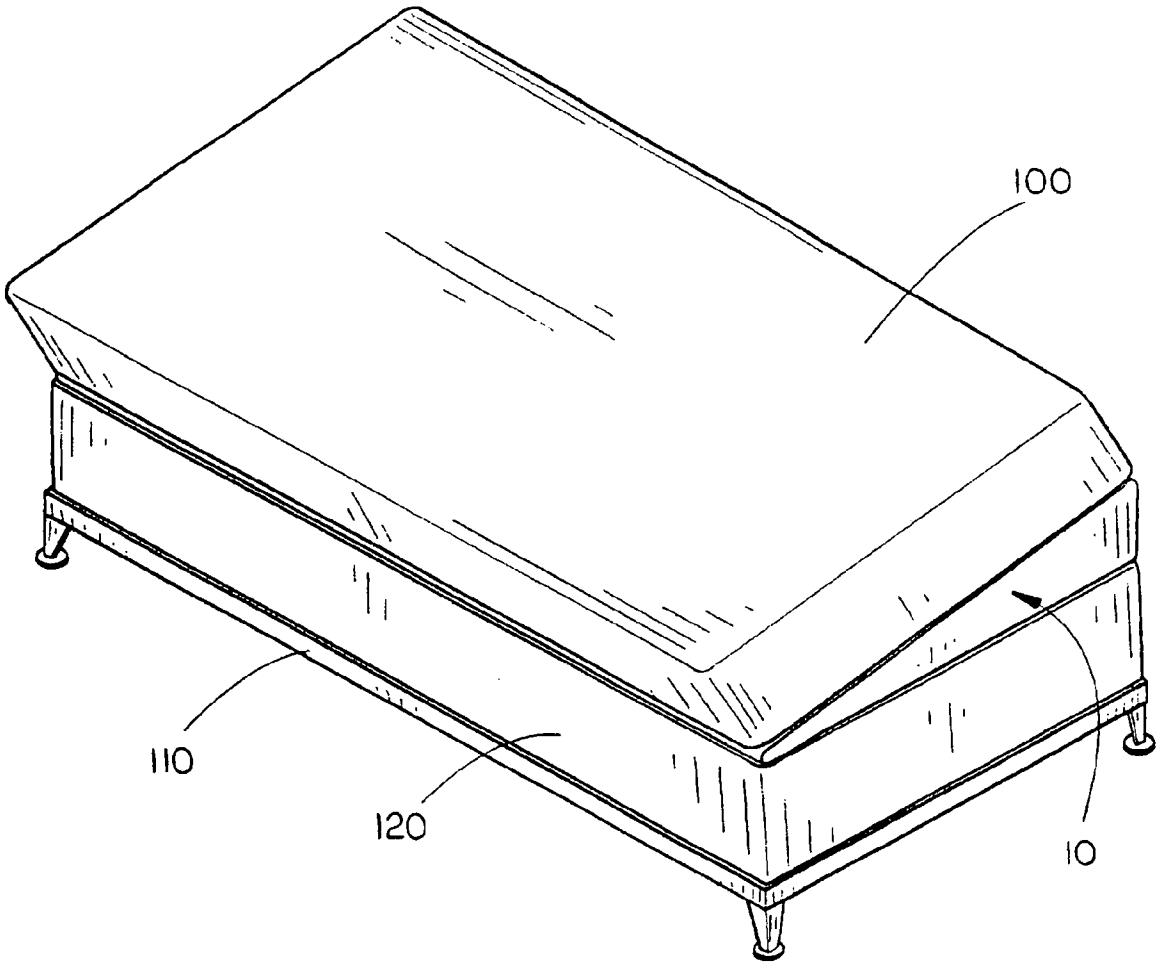
FIG. 2 is a perspective view of the present invention showing the upper wedge-shaped air chamber being inflated to adjust the yaw orientation of the mattress relative to horizontal and further shows the head and shoulders support air bladder likewise being inflated.

The bedsore reduction system of the present invention is shown best in FIGS. 1-6 as being mounted on a standard bed frame 110 and as having a standard therapeutic-type mattress 100 positioned on top of the bedsore reduction system 10 which rests on the box spring 120. It should be noted that although the bed frame 110 and mattress 100 as shown are likely of the twin size and are likely of standard design, it is entirely possible to use the bedsore reduction system 10 of the present invention in connection with specially designed mattresses and other types of bed support frames 110, any of which would be usable with the present invention.

Figure 3:
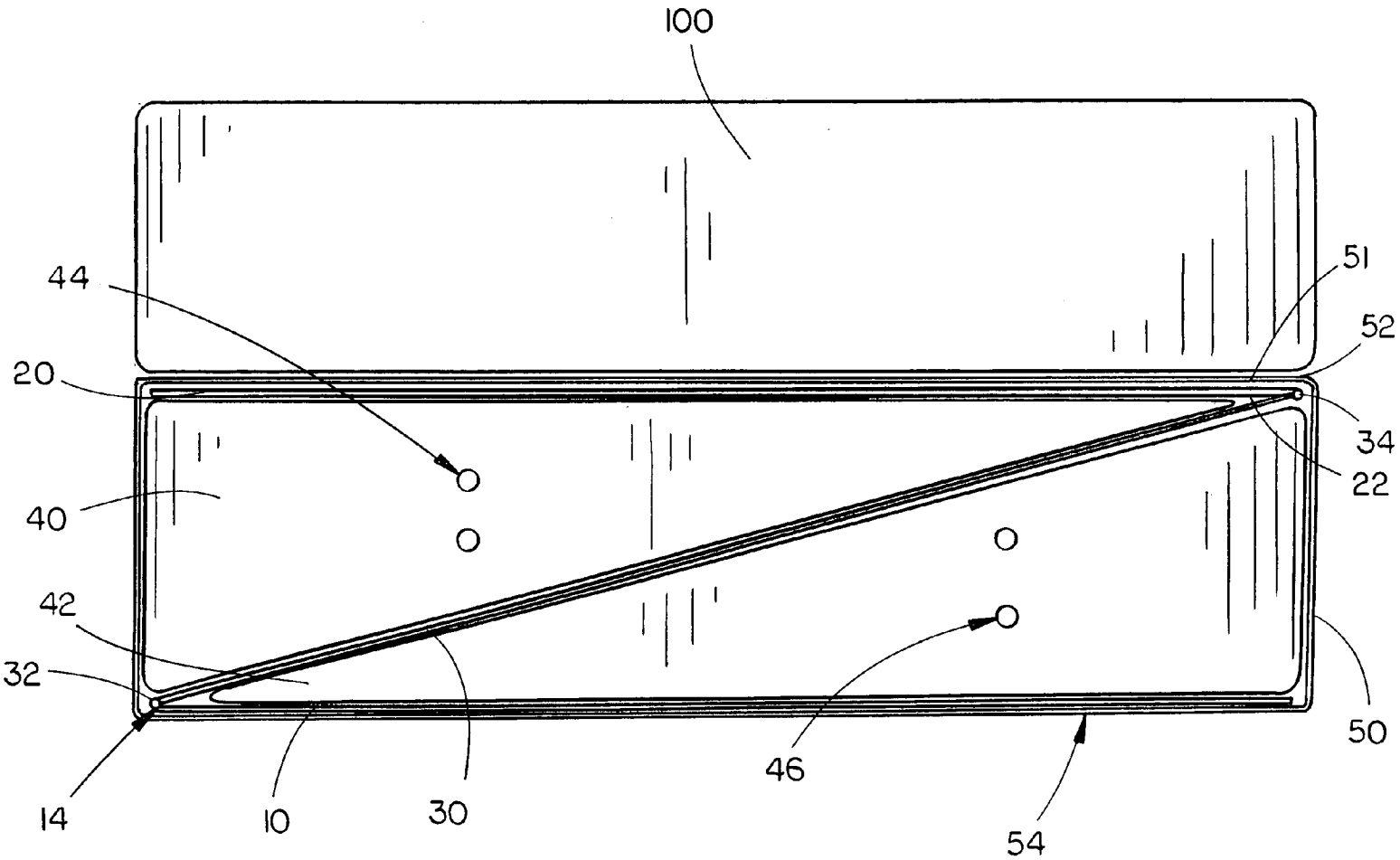
FIG. 3 is a detailed end elevational view of the present invention showing the positioning of the plates and air chambers therewithin.
Figure 4:
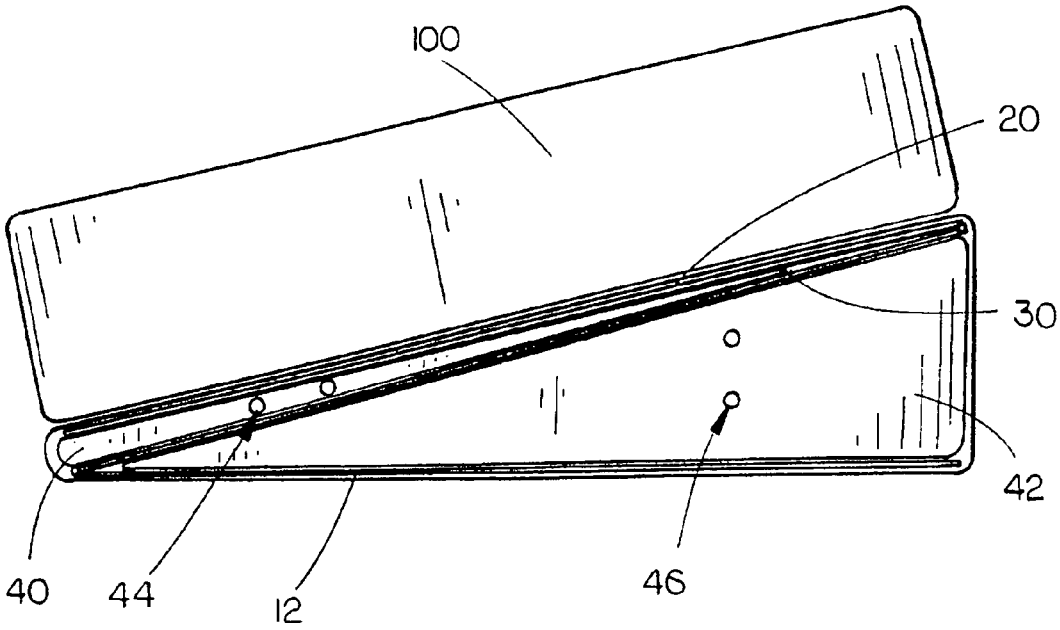
FIG. 4 is a detailed end elevational view showing the lower wedge-shaped air chamber being inflated.
Figure 5:
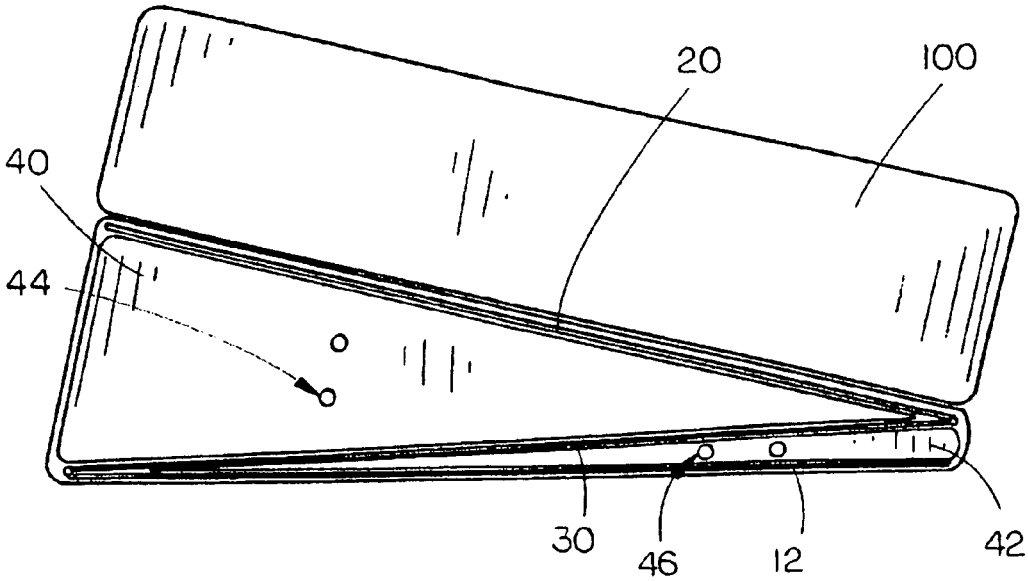
FIG. 5 is a detailed end elevational view showing the upper wedge-shaped air chamber being inflated to tilt the mattress in the opposite direction.

The structural elements of the bedsore reduction system 10 of the present invention are shown best in FIGS. 3, 4, and 5 as including a generally rectangular base plate 12 which, in the preferred embodiment, would be approximately three feet in width, six feet in length, and would have a thickness of approximately one quarter to one-half inch. It is further preferred that the base plate 12 be constructed of a light-weight and rigid construction material such as molded PVC or plastic, although the precise construction material used in connection with base plate 12 is not critical to the present invention so long as the base plate 12 is rigid and generally planar.

A generally rectangular mattress support plate 20 is positioned above and extends generally parallel with base plate 12, the mattress support plate 20 having generally the same dimensions and being constructed of the same construction materials as used in connection with base plate 12. Extending between and connecting the base plate 12 and mattress support plate 20 is a diagonal connecting plate 30 which, in the preferred embodiment, would be constructed of the same general construction material as used in connection with base plate 12 and mattress support plate 20 but would have slightly different dimensions in order to connect the base plate 12 and mattress support plate 20, as shown best in FIGS. 3, 4, and 5, specifically that the width of the diagonal connecting plate 30 would be greater than the width of the base plate 12 or mattress support plate 20. As shown best in FIG. 3, diagonal connecting plate 30 would extend from the first side edge 14 of base plate 12 upwards to the second side edge 22 of mattress support plate 20, and the connection between the base plate 12 and diagonal connecting plate 30 and mattress support plate 20 and diagonal connecting plate 30 would be pivoting hinges 32 and 34. The precise nature of the hinge connections 32 and 34 between base plate 12 and diagonal connecting plate 30 and diagonal connecting plate 30 and mattress support plate 20 are not critical to the present invention so long as the plates 12, 20, and 30 may freely pivot about the hinges 32 and 34, although it is preferred that the hinges 32 and 34 be constructed of either a sturdy vinyl connecting material such as that used in connection with water beds or the like or consist of actual metal or plastic hinges which connect the plates to one another.

Once the base plate 12, diagonal connecting plate 30, and mattress support plate 20 are connected to one another, the "Z" cross-sectional shape of the assembled plates is clear, particularly as shown in FIG. 3. Of course, however, the plates will not remain in their intended positions without providing an associated support structure to be used in connection with the present invention and the particular operative element to be used herewith consists of an upper and a lower wedge-shaped air chamber 40 and 42 would be positioned, respectively, between the mattress support plate 20 and diagonal connecting plate 30 and between the base plate 12 and diagonal connecting plate 30, as shown best in FIG. 3. In the preferred embodiment, the upper and lower wedge-shaped air chambers 40 and 42 would be constructed as wedges having generally triangular cross-sectional shape with the length and width of each of the air chambers 40 and 42 being approximately equal to the dimensions of the base and mattress support plates 12 and 20. The height of the air chambers 40 and 42 would preferably be approximately four to eight inches tapering to a point positioned generally adjacent the respective hinges 32 and 34, as shown best in FIG. 3. It is preferred that the upper and lower air chambers 40 and 42 would be constructed of a puncture-resistant plastic, rubber or vinyl material such as that used in connection with heavy duty air bladders and water bladders currently available in the market place.

Once the base plate 12, mattress support plate 20 and diagonal connecting plate 30 are connected to one another via hinges 32 and 34, the upper and lower wedge-shaped air chambers 40 and 42 may be slid into position, as shown in FIG. 3, and may be secured in that position by the frictional contact between the air chambers 40 and 42 and the various plates 12, 20, and 30, or, alternatively, a hook-and-loop fastening material may be used to releasably secure the upper and lower air chambers 40 and 42 between the base plate 12, mattress support plate 20, and diagonal connecting plate 30. Once the plates and air chambers are assembled, the entire structural unit is encased in a heavy duty fabric cover 50 which, in the preferred embodiment, would be a fabric material such as that used in connection with mattresses and the like, and would preferably also include a zipper (not shown) or other such access-permitting opening which will permit the operator of the present invention to access the internal components of the bedsore reduction system 10. Once the entire unit is assembled, the resulting system has a length of approximately six feet, a width of approximately three feet, and a height of approximately four to eight inches, and therefore is of an appropriate size to rest on or replace a standard box spring or the like and therefore be used in connection with an already-purchased mattress 100 such as the one shown in the various drawings. Finally, it may be preferable to include a non-slip material on the top face 52 and bottom face 54 of the fabric cover 50 in order to lessen the chances of the mattress 100 slipping off of the bedsore reduction system 10 when adjustments in the yaw orientation of the mattress are performed. It is expected that the non-slip material 51 would be a rubberized material such as that used in connection with non-slip devices, or alternatively the mattress 100 may be secured on the bedsore reduction system 10 by straps or the like, if a more secure mounting for the mattress 100 is necessary.

The present invention further contemplates the use of a head and shoulder adjustment air chamber 60 which, in the preferred embodiment, would be a wedge-shaped air chamber having approximate dimensions of three feet in width and two feet in length with a thickness at the wide end thereof of approximately eight to twelve inches. In the preferred embodiment, the head and shoulder adjustment air chamber 60 would be positioned between the mattress support plate 20 and the mattress 100 underneath the mattress 100 or, alternatively, could be positioned atop the mattress 100 if the air chamber 60 is separable from the main unit, depending on the type of mattress 100 being used and the desired vertical adjustment capabilities to be provided by the head and shoulder adjustment air chamber 60. It is generally preferred that the head and shoulder adjustment air chamber 60 be constructed of a similar material in a similar manner as that described in connection with upper and lower wedge-shaped air chambers 40 and 42.

Figure 6:
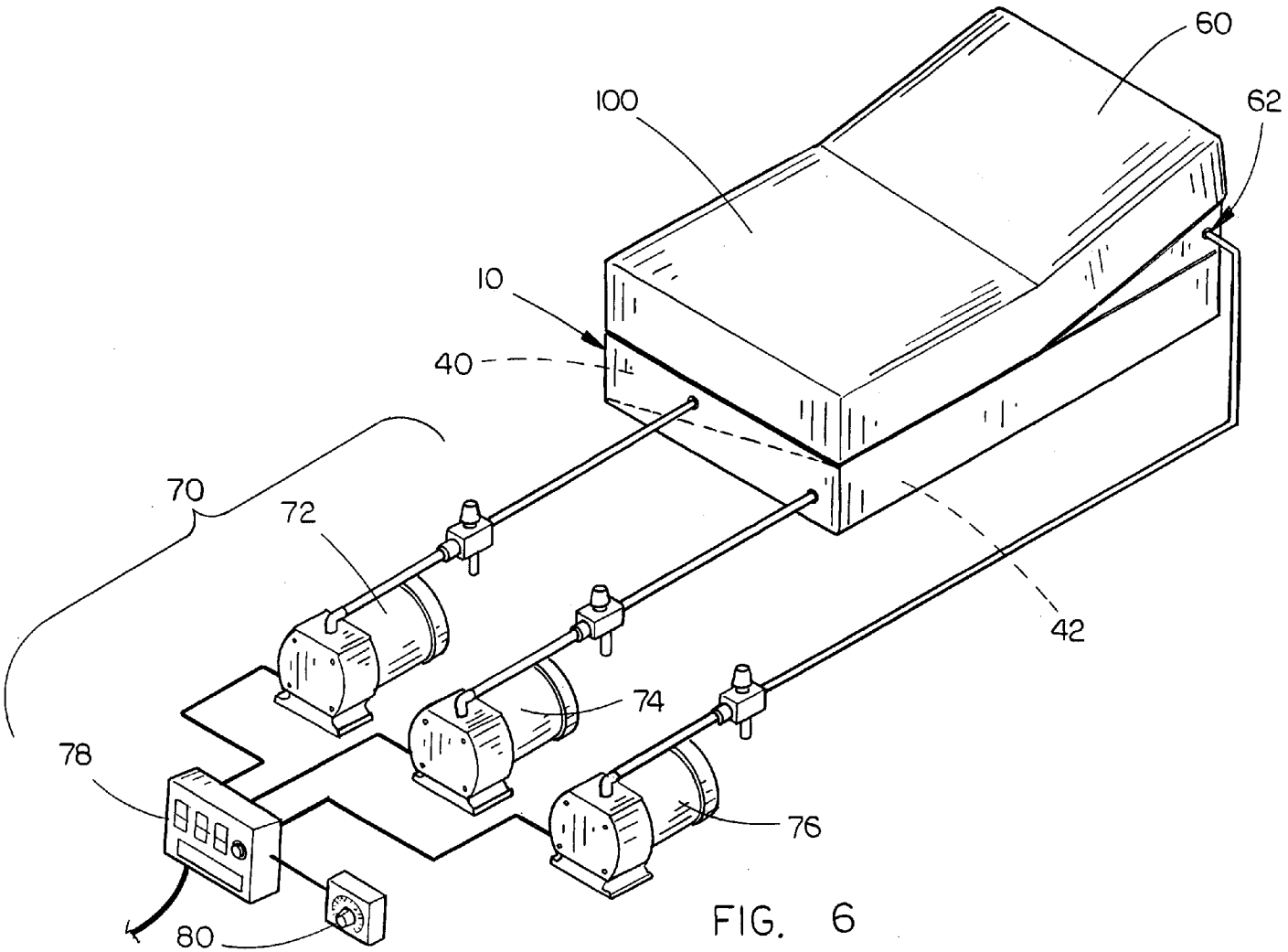
FIG. 6 is a detailed perspective view of the controllable inflation device of the present invention showing connection of the air pumps to the various air chambers.

Inflation and deflation of the upper and lower wedge-shaped air chambers 40 and 42 and the head and shoulder adjustment air chamber 60 would be provided by a controllable inflation device 70 which, in the preferred embodiment, would consist of three separate air pumps 72, 74, and 76, each connected to one of the upper and lower wedge-shaped air chambers 40 and 42 and the head and shoulder adjustment air chamber 60, as shown in FIG. 6. The controllable inflation device 70 would further include a control device 78 and timer 80 which would be interposed between the air pumps 72, 74, and 76 and the electrical power supply 82 which provides power to the air pumps. In the preferred embodiment, the control device 78 and timer 80 may be made of any appropriate design, although it is preferred that a programmable system which controls the operation of the air pumps 72, 74, and 76 is preferred. When in operation, the air pumps 72, 74, and 76 inflate the respectively connected upper and lower wedge-shaped air chambers 40 and 42 and head and shoulder adjustment air chamber 60 as commanded by the control device 78 and timer 80.

Of course, once the upper and lower wedge-shaped air chambers 40 and 42 and the head and shoulder adjustment air chamber 60 are inflated, air release outlets must be provided in order to permit the various air chambers 40, 42, and 60 to deflate. Therefore, each of the air chambers 40, 42, and 60 are provided with adjustable air relief valves 44, 46, and 62 which are designed to adjustably release air from inside the associated air chamber 40, 42, and 60. These relief valves 44, 46, and 62 may be adjusted to slowly or quickly release air from inside the air from inside the air chambers 40, 42, and 60 and also are operative to prevent overinflation of the air chambers 40, 42, and 60 thereby preventing damage to the air chambers.

FIGS. 4 and 5 illustrate how the bedsore reduction system 10 of the present invention changes the yaw orientation of the mattress 100 relative to the base plate 12. Specifically, by alternatively inflating the upper or lower wedge-shaped air chambers 40 and 42, the mattress 100 may be tilted to the left or right as shown in FIGS. 4 and 5, depending on the intended orientation of the mattress 100 to prevent bedsores in the patient laying on the mattress 100. It should be noted that the illustrations of FIGS. 4 and 5 have been exaggerated to fully disclose the operational features of the present invention, but it should be noted that the actual displacement of the mattress 100 in the yaw orientation would be approximately one to three inches for a hard mattress or three to five inches for a softer mattress, again depending on the needs of the patient using the mattress 100.

A typical bedsore reduction cycle of the bedsore reduction system 10 of the present invention will now be described. As the preferred amount of time for a cycle would be approximately two hours, as was discussed previously, it is expected that the bedsore reduction system 10 of the present invention would generally be used in connection with a two hour cycle. In this cycle, air pump 72 would be initiated to inflate upper wedge-shaped air chamber 40 to tilt mattress 100, as shown in FIG. 5, thereby reducing the amount of pressure due to gravity on the patient's right side. The air pump 72 would be operated for approximately twenty minutes at which time the timer 80 as connected to control device 78 would shut off the air pump 72. The adjustable air relief valve 44 of upper wedge-shaped air chamber 40 would then slowly release air held within the air chamber 40 allowing the air chamber 40 to slowly deflate to return the mattress 100 to a generally level position. Air pump 74 would then be engaged by the operation of timer 80 in connection with control device 78 to operate for approximately twenty minutes to inflate lower wedge-shaped air chamber 42, as shown best in FIG. 4. This, in turn, causes mattress 100 to be tilted to the left, thus reducing pressure on the left side of the patient's body. The adjustable relief valve 46 on lower wedge-shaped air chamber 42 then slowly releases the air from inside the air chamber 42 to return the mattress 100 to its generally level position. Finally, air pump 76 would be initiated by operation of the timer 80 and control device 78 to inflate the head and shoulder adjustment air chamber 60, thereby raising the patient's upper torso and head relative to the base plate 12. Again, the adjustable air relief valve 62 of head and shoulder adjustment air chamber 60 would slowly release air from within the air chamber 60 to return the air chamber 60 to its pre-inflated position. At this time, approximately two hours has passed and the cycle begins again to continuously cycle through the operation of air pumps 72, 74, and 76, thereby continually adjusting the yaw orientation of the mattress 100 and therefore continually changing the positioning of the pressure points on the patient's body to significantly reduce and in many cases eliminate the development of bedsores.

It is to be understood that numerous additions, modifications and substitutions may be made to the bedsore reduction system 10 of the present invention which fall within the intended broad scope of the appended claims. For example, the size, shape and construction materials used in connection with the various elements of the invention may be modified or changed so long as the functionality of the invention is not degraded nor destroyed. Furthermore, although the present invention has been described as being used in connection with air pumps and air bladders/chambers, various other types of chambers may be used, such as water chambers to create a "water bed effect," which may be deemed beneficial to the patient. Also, the particular design and capacities of the air pumps 72, 74, and 76 may be modified or changed, along with the specific nature of the control device 78 and timer 80, so long as the intended functionality of the present invention is neither degraded nor destroyed. It also should be noted that a manual adjustment control device 84 may be included with the present invention in operative connection with the control device 78 in order to permit manual adjustment of the inflation and deflation of the air chambers 40, 42, and 60, as may be required by health care professionals in their care-providing duties. Finally, it should be noted that the diagonal connecting plate 30 may be replaced by a plurality of diagonal connecting struts without greatly affecting the performance and functionality of the bedsore reduction system 10 of the present invention, although it has been found that use of a full plate for diagonal connecting plate 30 is preferable.

There has therefore been shown and described as bedsore reduction system 10 for beds which accomplishes at least all of its intended objectives.

I claim:

1. A bedsore reduction system for beds comprising:

a generally rectangular base plate having front and rear edges and first and second side edges;

a generally rectangular mattress support plate operative to support a mattress thereon and having front and rear edges and first and second side edges;

a diagonal connecting plate extending between said base plate and said mattress support plate and pivotably connecting said first side edge of said base plate and said second side edge of said mattress support plate;

an inflatable upper wedge-shaped air chamber having a generally triangular cross-sectional shape, said upper wedge-shaped air chamber positioned between said mattress support plate and said diagonal connecting plate;

an inflatable lower wedge-shaped air chamber having a generally triangular cross-sectional shape, said lower wedge-shaped air chamber positioned between said base plate and said diagonal connecting plate; and controllable inflation means operatively connected to said upper and lower wedge-shaped air chambers for inflating and deflating said upper and lower wedge-shaped air chambers such that said diagonal connecting plate is pivotable relative to said base plate via inflation and deflation of said lower wedge-shaped air chamber and said mattress support plate is pivotable relative to said diagonal connecting plate via inflation and deflation of said upper wedge-shaped air chamber thereby adjusting the yaw orientation relative to horizontal of a mattress supported on said mattress support plate.

2. The bedsore reduction system of claim 1 further comprising a head and shoulder adjustment wedge-shaped air chamber positioned between said mattress support plate and the mattress supported on said mattress support plate.

3. The bedsore reduction system of claim 2 wherein said pivotable connections between said first side edge of said base plate and said diagonal connecting plate and said second side edge of said mattress support plate and said diagonal connecting plate each comprise hinges constructed of a flexible impervious sheet material.

4. The bedsore reduction system of claim 3 wherein said upper wedge-shaped air chamber and said lower wedge-shaped air chamber each further include narrow and wide ends, said narrow ends of said upper wedge-shaped air chamber and said lower wedge-shaped air chamber positioned adjacent said hinges whereby said upper wedge-shaped air chamber and said lower wedge-shaped air chamber are positioned in a vertical stacked orientation one above the other.

5. The bedsore reduction system of claim 4 wherein said base plate, said mattress support plate and said diagonal connecting plate are each constructed of a fluid-impermeable rigid plate material.

6. The bedsore reduction system of claim 2 wherein said controllable inflation means comprises three separate air pumps, each connected to a respective one of said upper and lower wedge-shaped air chambers and said head and shoulder adjustment air chamber, said controllable inflation means further including a control device operatively connected to said three separate air pumps for engaging and disengaging said three separate air pumps to alternatively inflate and deflate said upper and lower wedge-shaped air chambers and said head and shoulder adjustment air chamber.

7. The bedsore reduction system of claim 6 further comprising a timer operatively connected to said control device, said timer operative to engage said control device to engage and disengage said three separate air pumps to alternatively inflate and deflate said upper and lower wedge-shaped air chambers and said head and shoulder adjustment air chamber.

8. The bedsore reduction system of claim 1 wherein said controllable inflation means comprises two separate air pumps, each connected to a respective one of said upper and lower wedge-shaped air chambers, said controllable inflation means further including a control device operatively connected to said two separate air pumps for engaging and disengaging said two separate air pumps to alternatively inflate and deflate said upper and lower wedge-shaped air chambers.

9. The bedsore reduction system of claim 8 further comprising a timer operatively connected to said control device, said timer operative to engage said control device to engage and disengage said two separate air pumps to alternatively inflate and deflate said upper and lower wedge-shaped air chambers.

10. A bedsore reduction system for beds comprising:

a generally rectangular base plate having front and rear edges and first and second side edges;

a generally rectangular mattress support plate operative to support a mattress thereon and having front and rear edges and first and second side edges;

a diagonal connecting means extending between said base plate and said mattress support plate and pivotable connections connecting said first side edge of said base plate and said second side edge of said mattress support plate;

an inflatable upper wedge-shaped air chamber positioned between said mattress support plate and said diagonal connecting means;

an inflatable lower wedge-shaped air chamber positioned between said base plate and said diagonal connecting means;

a head and shoulder adjustment wedge-shaped air chamber supported on top of said mattress support plate; and controllable inflation means operatively connected to said upper and lower wedge-shaped air chambers and said head and shoulder adjustment wedge-shaped air chamber for inflating and deflating said upper and lower air chambers and said head and shoulder adjustment air chamber such that said diagonal connecting means is pivotable relative to said base plate via inflation and deflation of said lower wedge-shaped air chamber, said mattress support plate is pivotable relative to said diagonal connecting means via inflation and deflation of said upper wedge-shaped air chamber thereby adjusting the yaw orientation relative to horizontal of a mattress supported on said mattress support plate and the forward end of said mattress is adjustable vertically via inflation or deflation of said head and shoulder adjustment air chamber.

11. The bedsore reduction system of claim 10 wherein said head and shoulder adjustment wedge-shaped air chamber is positioned between said mattress support plate and the mattress supported on said mattress support plate.

12. The bedsore reduction system of claim 11 wherein said pivotable connections between said first side edge of said base plate and said diagonal connecting plate and said second side edge of said mattress support plate and said diagonal connecting means each comprise hinges constructed of a flexible impervious sheet material.

13. The bedsore reduction system of claim 12 wherein said upper wedge-shaped air chamber and said lower wedge-shaped air chamber each further include narrow and wide ends, said narrow ends of said upper wedge-shaped air chamber and said lower wedge-shaped air chamber positioned adjacent said hinges whereby said upper wedge-shaped air chamber and said lower wedge-shaped air chamber are positioned in a vertical stacked orientation one above the other.

14. The bedsore reduction system of claim 13 wherein said base plate, said mattress support plate and said diagonal connecting means are each constructed of a fluid-impermeable rigid plate material.

15. The bedsore reduction system of claim 11 wherein said controllable inflation means comprises three separate air pumps, each connected to a respective one of said upper and lower wedge-shaped air chambers and said head and shoulder adjustment air chamber, said controllable inflation means further including a control device operatively connected to said three separate air pumps for engaging and disengaging said three separate air pumps to alternatively inflate and deflate said upper and lower wedge-shaped air chambers and said head and shoulder adjustment air chamber.

16. The bedsore reduction system of claim 15 further comprising a timer operatively connected to said control device, said timer operative to engage said control device to engage and disengage said three separate air pumps to alternatively inflate and deflate said upper and lower wedge-shaped air chambers and said head and shoulder adjustment air chamber.

17. The bedsore reduction system of claim 10 wherein said controllable inflation means comprises two separate air pumps, each connected to a respective one of said upper and lower wedge-shaped air chambers, said controllable inflation means further including a control device operatively connected to said two separate air pumps for engaging and disengaging said two separate air pumps to alternatively inflate and deflate said upper and lower wedge-shaped air chambers.

18. The bedsore reduction system of claim 17 further comprising a timer operatively connected to said control device, said timer operative to engage said control device to engage and disengage said two separate air pumps to alternatively inflate and deflate said upper and lower wedge-shaped air chambers.

* * * * *